US005931042A

United States Patent [19]

Kanemitsu et al.

[11] Patent Number: 5,931,042

[45] Date of Patent: Aug. 3, 1999

[54] METHOD OF FORMING A KEY PORTION OF A SHEET METAL MEMBER HAVING A CYLINDRICAL PORTION

[75] Inventors: Toshiaki Kanemitsu, Kobe; Kunihiro Harada, Miki; Naoki Fujii, Kobe, all of Japan

[73] Assignee: Kabushiki Kaisha Kanemitsu, Akashi, Japan

[21] Appl. No.: 09/005,822

[22] Filed: Jan. 12, 1998

[30] Foreign Application Priority Data

Jan. 27, 1997 [JP] Japan ..... 9-012562

[51] Int. Cl.[6] ..... B21D 53/26

[52] U.S. Cl. ..... 72/354.6; 29/894.362

[58] Field of Search ..... 72/325, 343, 352, 72/354.6, 355.2, 355.4, 358, 359, 377; 29/892, 894.362

[56] References Cited

U.S. PATENT DOCUMENTS

| | | | |
|---|---|---|---|
| 2,027,922 | 1/1936 | McNaught | 72/325 |
| 4,450,704 | 5/1984 | Schaeffler et al. | 72/359 |
| 5,195,241 | 3/1993 | Bradfield | 72/356 |

FOREIGN PATENT DOCUMENTS

| | | | |
|---|---|---|---|
| 3-86346 | 4/1991 | Japan | 72/355.6 |
| 6-297071 | 10/1994 | Japan | 72/355.4 |

*Primary Examiner*—Lowell A. Larson
*Attorney, Agent, or Firm*—Jones, Tullar & Cooper, P.C.

[57] ABSTRACT

The present invention relates to a method of forming a key portion on a sheet metal member, the key portion being useful in coupling of a shaft to a member such as a pulley used in an automobile. According to the method of the invention, an inner metal part of a cylindrical portion of the sheet metal member is pressed in the axial direction so that the inner metal part is removed away and a predetermined place of the inner metal part remains, the remaining metal part being used as the key portion. Pressing the inner metal part in the axial direction of the cylindrical portion can be conducted by a pressing process in which a pressing die is moved in the axial direction of the cylindrical portion. A key portion can be easily formed on the cylindrical portion, and an inner flange can be formed together with the key portion. Therefore, a member having a cylindrical portion which has a key portion and an inner flange can be provided without using a casting process, as a lightweight sheet metal member which is tough and economical.

10 Claims, 9 Drawing Sheets

METHOD OF FORMING A KEY PORTION OF A SHEET METAL MEMBER HAVING A CYLINDRICAL PORTION

CROSS REFERENCE TO RELATED APPLICATION

This application discloses subject matter also disclosed in co-pending application Ser. No. 09/005,714 filed on Jan. 12, 1998.

FIELD OF THE INVENTION

The present invention relates to a method of forming a key portion of a sheet metal member having a cylindrical portion, and particularly to a method in which a key portion of a sheet metal member is formed, the key portion being useful in coupling of a shaft to a member such as a pulley of a rotation transmission mechanism, e.g., a pulley used in an automobile or that used in usual industrial equipment.

BACKGROUND OF THE INVENTION

When a shaft is to be coupled to a member having a circular shape or another shape so that these members are not relatively rotated, for example, a structure may be employed in which a key is fitted into key ways respectively formed in the shaft and a boss disposed on the member. This structure may be employed in a case such as that where the member is a pulley of a rotation transmission mechanism, e.g., a pulley used in an automobile or that used in usual industrial equipment, and the shaft serving as a rotating shaft is coupled to the pulley.

When the member is to be made of metal, the boss is usually formed by casting the member.

The fitted key should not be disengaged from the key ways during a period when the pulley and the shaft are rotated. Consequently, the key way formed in the boss and the key which is to be fitted into the key way are required to have very high processing and dimensional accuracies. When a coupling structure in which a key is fitted into key ways respectively formed in a shaft and a boss is employed, therefore, there arises a problem in that the burden in cost is large.

SUMMARY OF THE INVENTION

The present invention resulted from under the circumstance described above.

It is an object of the present invention to provide a sheet metal member with which a cylindrical portion such as a cylindrically-formed boss is integrated, a useful method of forming a key portion so as to be integrated with the cylindrical portion.

It is another object of the present invention to provide a method in which a key portion can be formed on the cylindrical portion by using a pressing process.

It is a further object of the present invention to provide a method in which a key portion and an inner flange can be formed on the cylindrical portion by using a pressing process.

In the method of forming a key portion of a sheet metal member having a cylindrical portion according to the present invention, an inner metal part of the cylindrical portion of a sheet metal member with which the cylindrical portion is integrated is pressed in an axial direction so that the inner metal part is removed away and a predetermined place of the inner metal part remains, and the remaining metal part is used as the key portion.

According to this method, a key portion can be easily formed integrally with the cylindrical portion which is integrated with the sheet metal member. In the method, a step of pressing the inner metal part in the axial direction may be conducted by a pressing process.

Preferably, the inner metal part of the cylindrical portion comprises an inner peripheral face having a diameter which is gradually reduced when moving toward an end in the axial direction of the cylindrical portion. According to the shape of the inner metal part, when the inner metal part is pressed in the axial direction, removal of the inner metal part, and formation of the remaining metal part can be easily conducted. In this case, the place from which the inner metal part is removed away can be easily determined to be an end part in the axial direction of the cylindrical portion.

In the method of forming a key portion of a sheet metal member having a cylindrical portion according to the present invention, the cylindrical portion of the sheet metal member with which the cylindrical portion is integrated is pressed in an axial direction to reduce an axial length of the cylindrical portion, and excess metal produced as a result of the reduction of the axial length of the cylindrical portion is partly projected into an inside of the cylindrical portion, and the partly projected part is used as the key portion.

According to this method also, a key portion can be easily formed integrally with the cylindrical portion which is integrated with the sheet metal member.

In the method of forming a key portion of a sheet metal member having a cylindrical portion according to the present invention, the cylindrical portion of the sheet metal member with which the cylindrical portion is integrated is pressed in an axial direction to reduce an axial length of the cylindrical portion, an excess metal produced as a result of the reduction of the axial length of the cylindrical portion is projected into an inside of the cylindrical portion, thereby forming an inner flange, and an inner peripheral part of the cylindrical portion is partly projected into the inside of the cylindrical portion, thereby forming the key portion.

According to this method, an inner flange against which an end face of a shaft abuts can be formed together with a key portion.

When this method is to be executed, an arbitrary place in the axial direction of the cylindrical portion may be selected as the place where the inner flange is formed by projecting the excess metal into the inside of the cylindrical portion. When an end part in the axial direction of the cylindrical portion is selected, the amount of the insertion of a shaft into the cylindrical portion can be sufficiently ensured so that the shaft and the cylindrical portion can be accurately set into a coaxial state.

The key portion may be formed by, in addition to the excess metal produced as a result of the reduction of the axial length of the cylindrical portion, a remaining metal produced by a part of the inner metal part remaining when the inner metal part of the cylindrical portion is removed away. According to this configuration, it is possible to sufficiently ensure the projection amount of the key portion.

Preferably, the cylindrical portion is formed as a cylindrical boss.

In the method of forming a key portion of a sheet metal member having a cylindrical portion according to the present invention, the formation of the inner flange and the formation of the key portion may be conducted by a pressing process in which a pressing die is moved in the axial direction of the cylindrical portion. In the method, it is preferable to conduct the pressing process under a state where the deformation of the outer peripheral face of the cylindrical portion is blocked by a first die face formed on the pressing die, or a state where the deformation of an end face of one end side of the cylindrical portion is blocked by a second die face formed on the pressing die.

As described above, according to the present invention, in a sheet metal member with which a cylindrical portion such as a boss is integrated, a key portion can be easily formed on the cylindrical portion. According to the present invention, an inner flange can be formed together with the key portion. Therefore, a member having a cylindrical portion which has a key portion and an inner flange can be provided without using a casting process, as a lightweight sheet metal member which is tough and economical. A sheet metal member having a cylindrical portion and produced by the present invention can be used as, for example, a pulley or a gear of a rotation transmission mechanism, e.g., a pulley used in an automobile or that used in usual industrial equipment.

BRIEF DESCRIPTION OF THE DRAWINGS

FIG. 2 is a view showing a sheet metal member having a cylindrical portion, a pressing die, and the like;

DETAILED DESCRIPTION OF THE PREFERRED EMBODIMENT

An embodiment of the method of the present invention will be described with reference to FIGS. 1 to 3.

Figure 1:
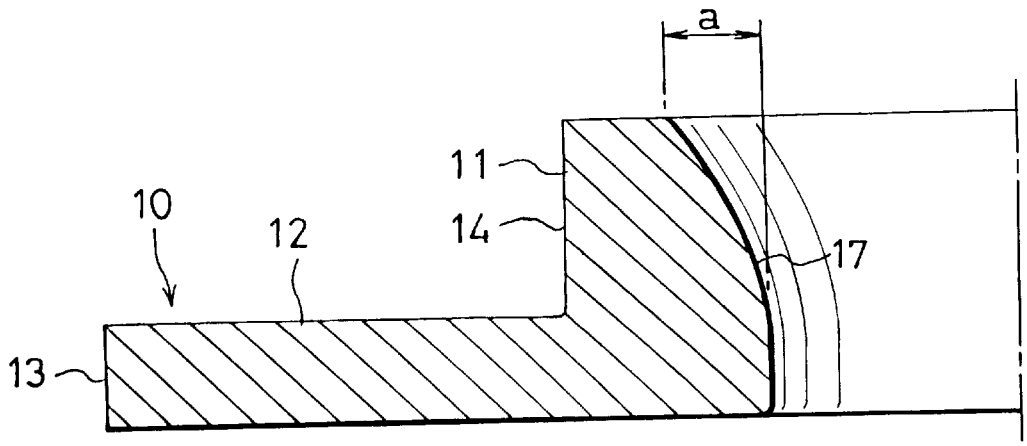
FIG. 1 is a partial section view of a sheet metal member having a cylindrical portion.

FIG. 1 shows a sheet metal member 10 with which a cylindrical portion 11 is integrated. In the sheet metal member 10, the cylindrical portion 11 is formed at the center of a circular plate portion 12. An inner peripheral face 17 of the cylindrical portion 11 has a diameter which is gradually reduced when moving toward an end (in the illustrated example, the lower end) in the axial direction of the cylindrical portion 11. Such a shape of the inner peripheral face 17 of the cylindrical portion 11 is formed by bending the inner peripheral face 17 in the axial direction of the cylindrical portion 11 as illustrated, or by forming the inner peripheral face 17 as a tapered face.

A key portion is formed on the cylindrical portion 11 which is integrated with the thus configured sheet metal member 10, in the following manner. An inner metal part 18 of the cylindrical portion 11 which part is radially inwardly projected by a distance indicated by the reference character a is removed away by pressing the inner metal part in the axial direction so that a predetermined place in the peripheral direction remains. The remaining metal part 19 is used as the key portion 20.

This method will be described more specifically. In the method, a support die 21, a holding die 25, and a pressing die 27 are used as shown in FIGS. 2 and 3. The sheet metal member 10 is placed on the support die 21 and the whole periphery of the outer peripheral end face 13 of the plate portion 12 is supported by a support face 22 formed in the support die 21. The support die 21 has a second die face 23 which is configured by a horizontal support face. The back face of the center portion of the sheet metal member 10 is supported by the second die face 23. By contrast, the holding die 25 has a first die face 26 which supports an outer peripheral face 14 of the cylindrical portion 11 to block the deformation of the outer peripheral face. In the pressing die 27, moreover, one place of the outer peripheral portion of the pressing die is cut away. The cutaway place is used as a recess 28 for forming the key portion. In the illustrated example, the inner wall face of the recess 28 is formed as an inclined face.

Figure 2:
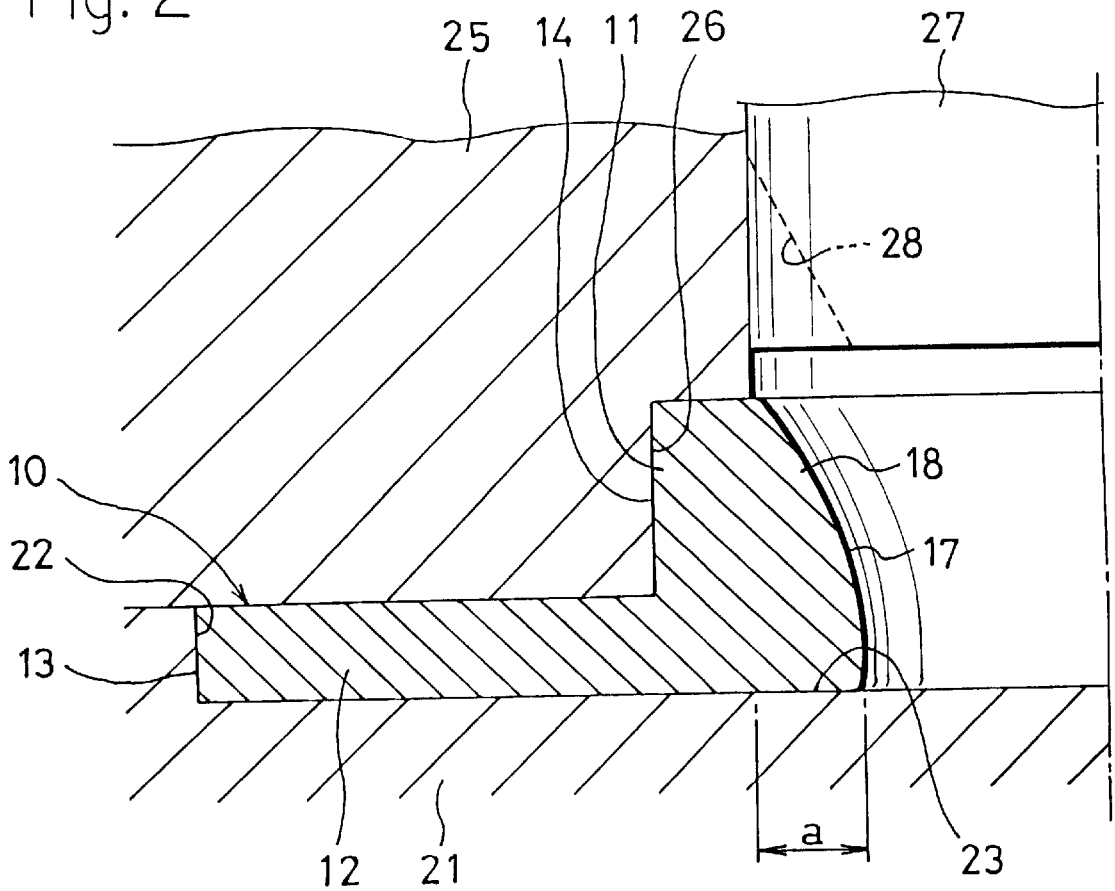
Figure 3:
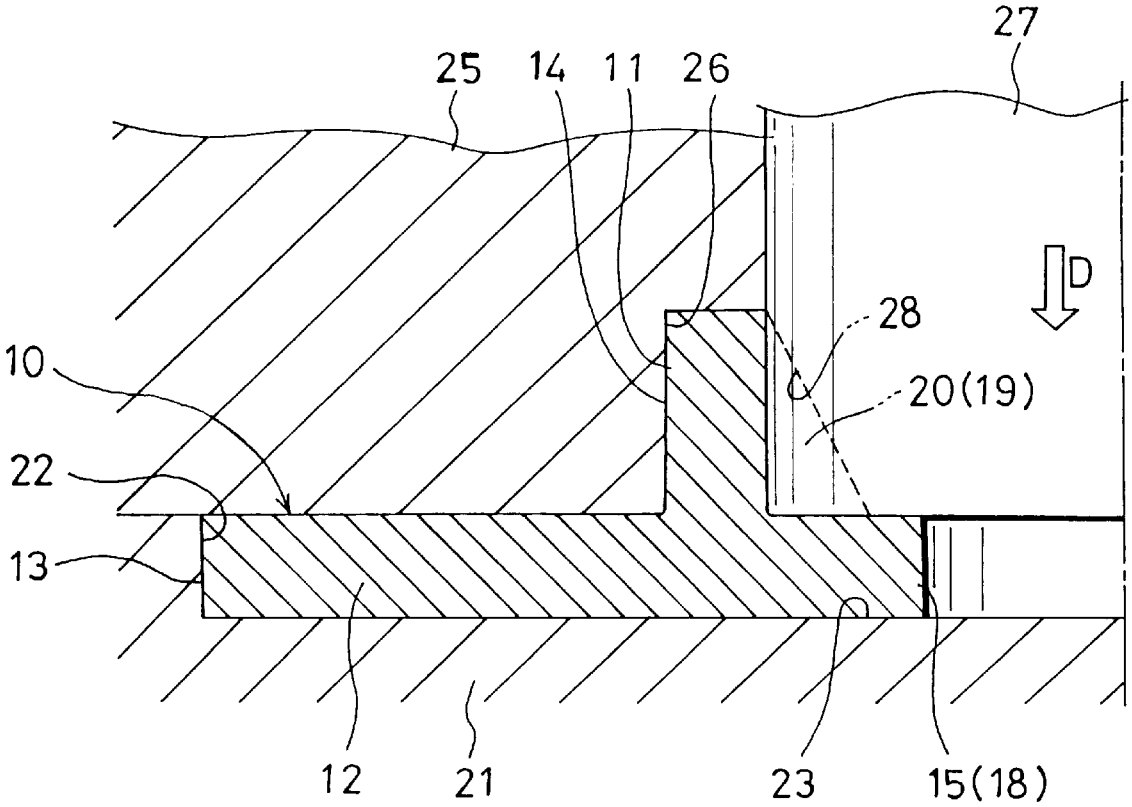
FIG. 3 is a view showing a key portion forming step.
Figure 4:
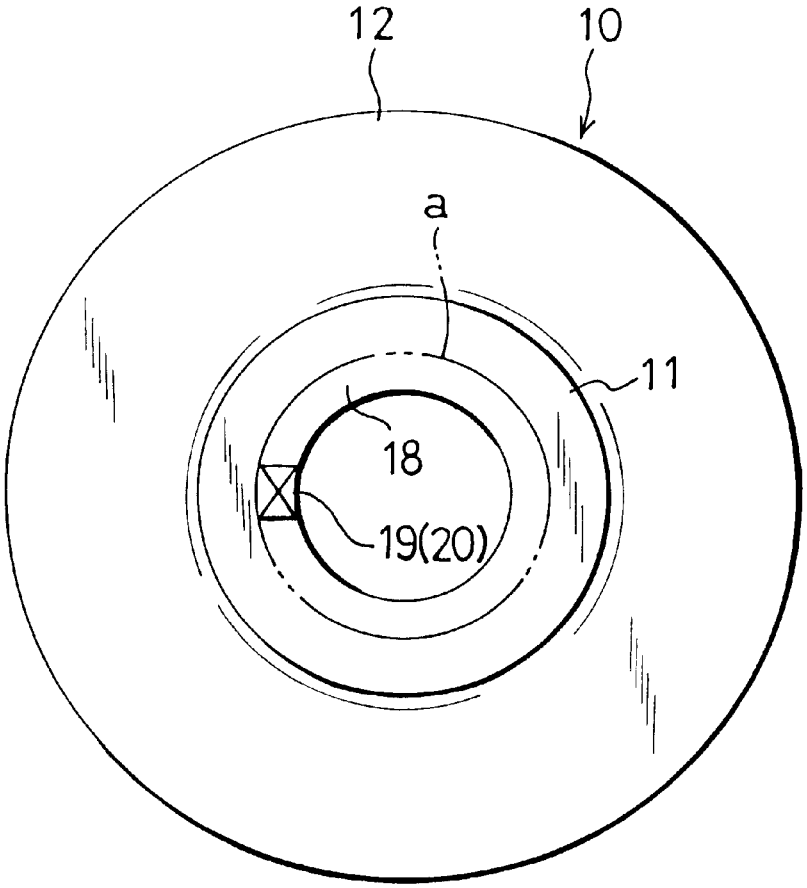
FIG. 4 is a view showing an excess part and a remaining part partitioned and formed on the cylindrical portion.

As shown in FIG. 2, the sheet metal member 10 is placed on the support die 21 and the whole periphery of the outer peripheral end face 13 of the plate portion 12 is supported by the support face 22 of the support die 21. The back face of the center portion of the sheet metal member 10 is supported by the second die face 23 of the support die 21, and the sheet metal member 10 is pressingly held by the holding die 25. Thereafter, the pressing die 27 is lowered from the upper side as shown by the arrow D of FIG. 3, thereby pressing the inner metal part 18 in the axial direction of the cylindrical portion 11. As a result, the inner metal part 18 flows downwardly (plastically flows). However, the remaining metal part 19 is received in the key forming recess 28 of the pressing die 27 so as to remain. This causes the remaining metal part 19 to be configured as the key portion 20 which projects from the cylindrical portion 11 into the inside of the portion. The inner metal part 18 other than the remaining metal part 19 projects as excess metal into the inside of the cylindrical portion 11 in one end part in the axial direction of the cylindrical portion 11, thereby forming an inner flange 15.

The support die 21, the holding die 25, and the pressing die 27 which have been described with reference to FIGS. 1 to 3 correspond to pressing dies attached to a press machine. Among these dies, the pressing die 27 is moved in the axial direction of the cylindrical portion 11.

Next, another embodiment of the method of the present invention will be described with reference to FIGS. 5 to 8.

Figure 5:
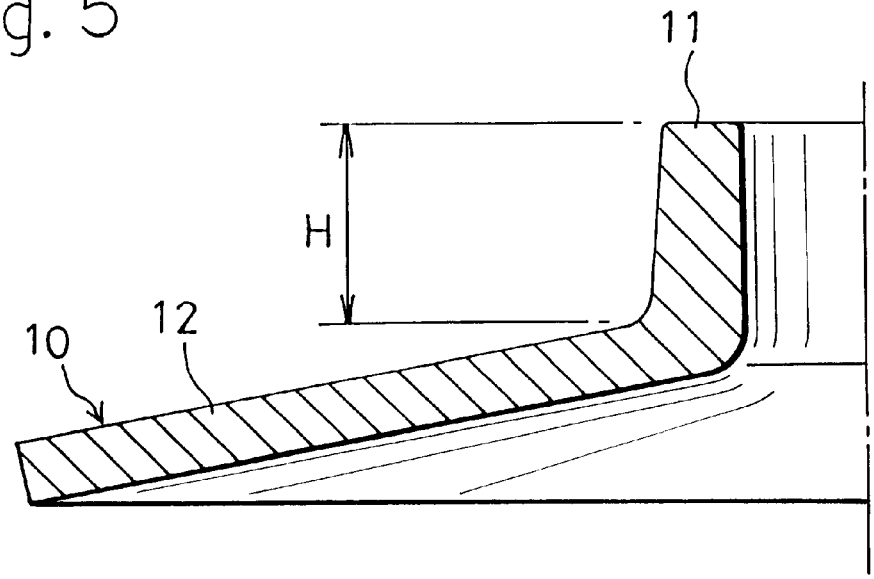
FIG. 5 is a partial section view of a sheet metal member having a cylindrical portion.

FIG. 5 shows the sheet metal member 10 having the cylindrical portion 11. In the sheet metal member 10, the cylindrical portion 11 is formed at the center of a circular plate portion 12 which is slightly inclined in a conical manner. The cylindrical portion 11 of the illustrated example is formed by conducting a burring process on the center of the plate portion 12, or by another method such as that in which a circular shape at the center of the plate portion 12 is punched out to form a circular hole and a drawing process is then conducted on the periphery of the circular hole. The cylindrical portion 11 of the sheet metal member 10 shown in FIG. 5 has a large height, and the axial length of the cylindrical portion is indicated by a reference letter H.

In the method of forming a key portion, an inner flange forming step, and a key portion forming step included in the inner flange forming step are conducted.

Figure 8:
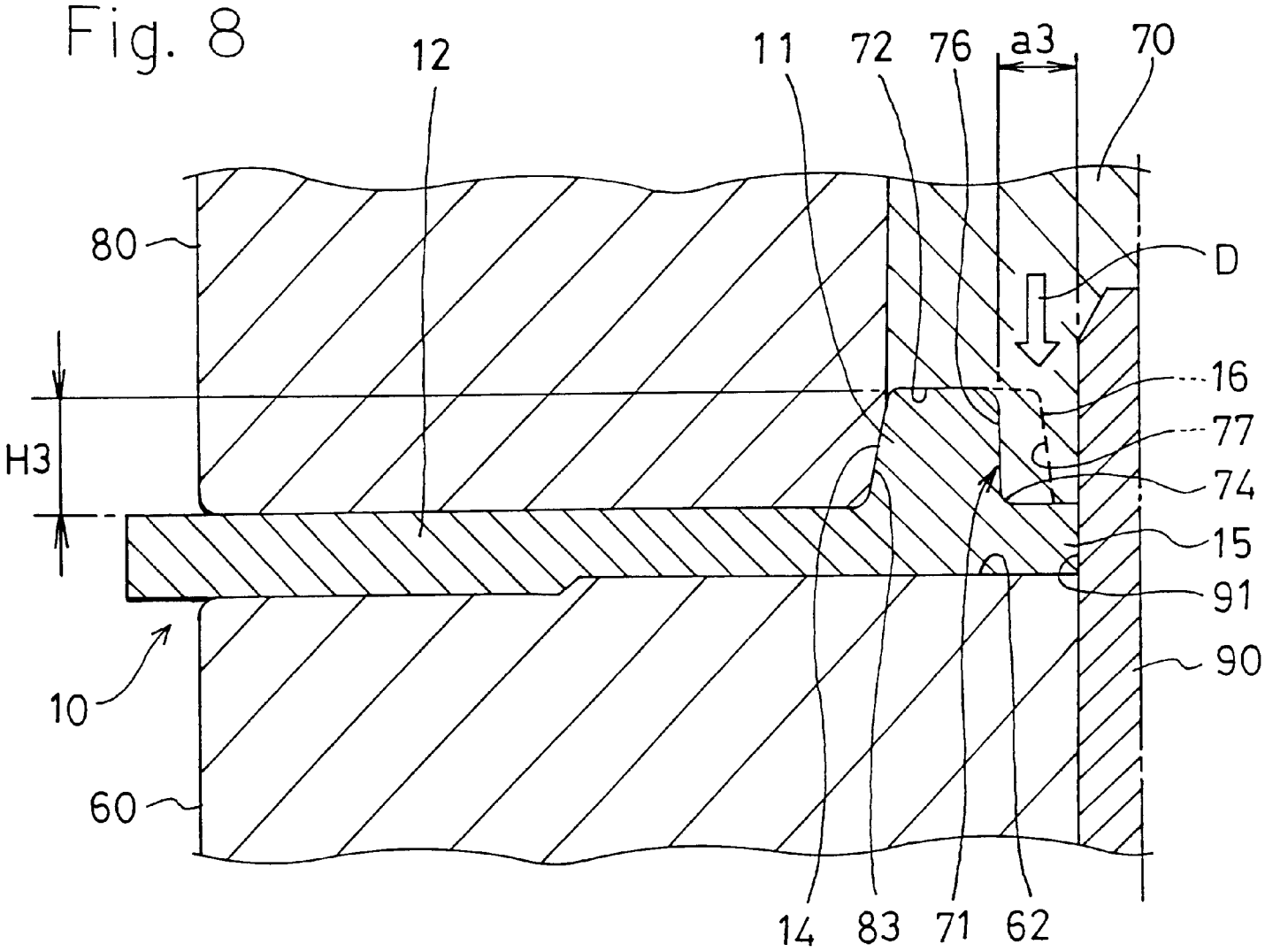
FIG. 8 is a view showing a partial section to illustrate a third stage (key portion forming step) of the step of forming an inner flange which step includes the key portion forming step.

In the inner flange forming step, the cylindrical portion 11 is pressed in its axial direction to reduce the axial length of the cylindrical portion 11, and the excess metal produced as a result of the reduction of the axial length of the cylindrical portion 11 is gathered to the end part in the axial direction of the cylindrical portion 11, thereby projecting the excess metal into the inside of the cylindrical portion 11 to form the inner flange 15 (see FIG. 8). In the illustrated method, the inner flange forming step is carried out in plural stages.

The key portion forming step is a step which is conducted after the inner flange forming step is carried out in plural stages. In the final stage of the inner flange forming step, namely, a part of the excess metal which projects into the inside of the cylindrical portion 11 as a result of the reduction of the axial length of the cylindrical portion 11 is used, and the excess metal part projects into a part in the peripheral direction of the inner peripheral portion of the cylindrical portion 11. The partly projected part is used as a key portion 16 (see FIG. 8).

Figure 6:
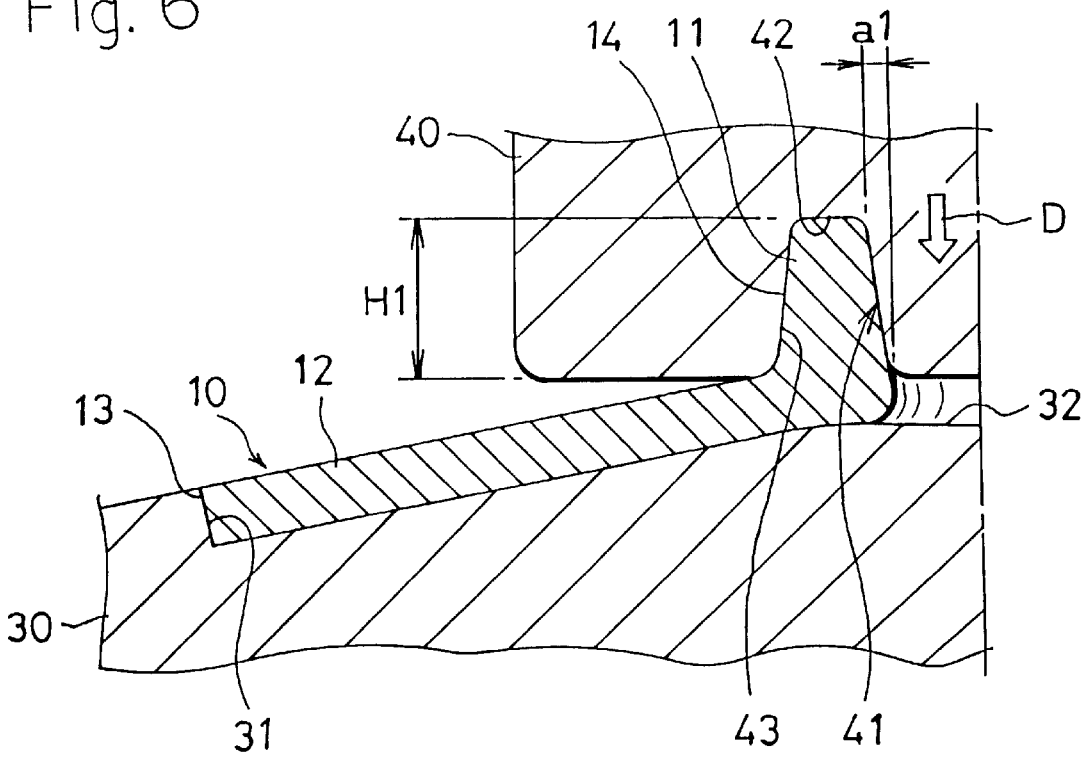
FIG. 6 is a view showing a partial section to illustrate a first stage of a step of forming an inner flange.

FIG. 6 shows a first stage of the inner flange forming step. In this stage, a first support die 30 and a first pressing die 40 are used. The sheet metal member 10 is placed on the first support die 30 and the whole periphery of the outer peripheral end face 13 of the plate portion 12 is supported by a support face 31 formed in the first support die 30. The first support die 30 has a second die face 32 which is configured by a horizontal support face. The back face of the center portion of the sheet metal member 10 is supported by the second die face 32. By contrast, the first pressing die 40 comprises an annular recess 41 which is recessed by a dimension that is slightly shorter than the axial length H of the cylindrical portion 11 described with reference to FIG. 5. The upper wall face of the recess 41 serves as a pressing face 42. The recess 41 has a size which enables the cylindrical portion 11 described with reference to FIG. 5 to be fitted into the recess. When the cylindrical portion 11 described with reference to FIG. 5 is fitted into the recess 41, the outer peripheral face 14 of the cylindrical portion 11 is supported by a first die face 43 which is formed by the outer peripheral face of the recess 41.

The sheet metal member 10 is placed on the first support die 30 of FIG. 6, the whole periphery of the outer peripheral end face 13 of the plate portion 12 is supported by the support face 31 of the first support die 30, and the back face of the center portion of the sheet metal member 10 is supported by the second die face 32 of the first support die 30. Thereafter, the first pressing die 40 is lowered from the upper side. As a result, the cylindrical portion 11 is fitted into the recess 41 of the first pressing die 40. Under this state, a load is applied to the first pressing die 40 so as to push down the first pressing die 40 as shown by the arrow D. Then, under the state where deformation of the outer peripheral face 14 of the cylindrical portion 11 is blocked by the first die face 43 and that of the end face of the one end (the end face on the side of the lower end) of the cylindrical portion 11 is blocked by the second die face 32, the cylindrical portion 11 is pressed in the axial direction by the pressing face 42. The pressing force exerted at this time causes the axial length H1 of the cylindrical portion 11 to be reduced to a value which is equal to the depth of the recess 41. Parallel with this reduction, excess metal produced as a result of the reduction of the axial length of the cylindrical portion 11 projects into the inside of the cylindrical portion 11. In FIG. 6, the width of the projection of the excess metal in this case is indicated by a reference numeral a1.

Figure 7:
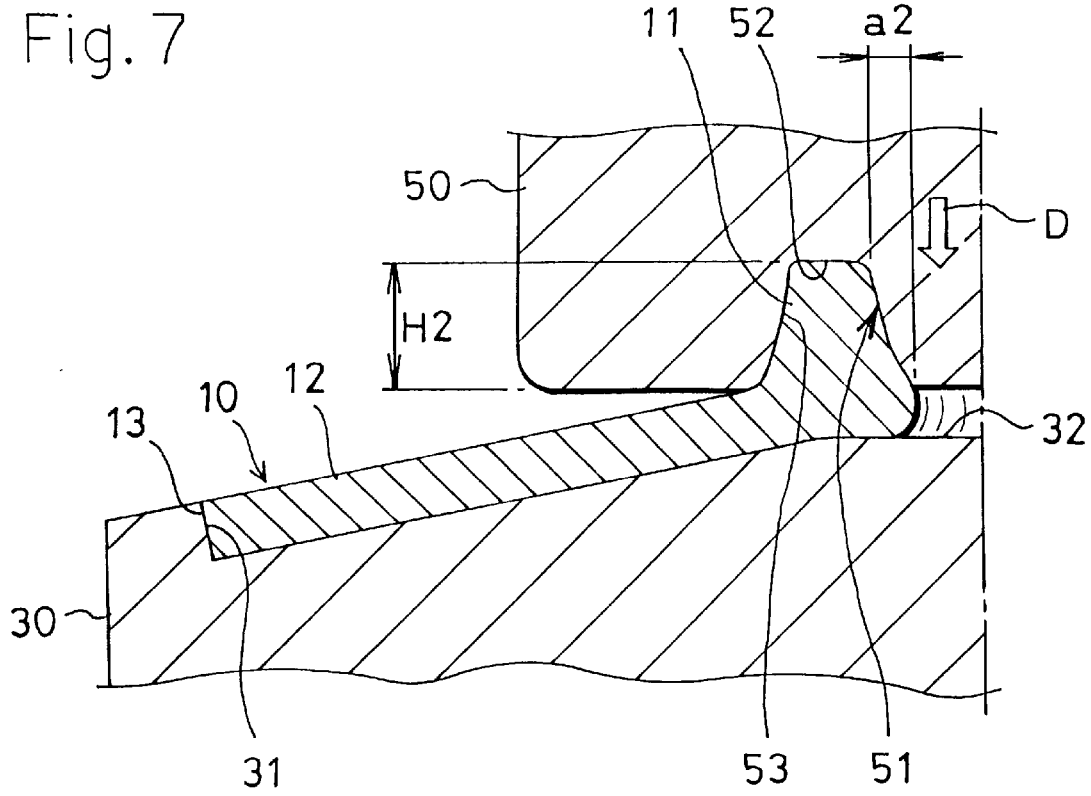
FIG. 7 is a view showing a partial section to illustrate a second stage of the step of forming an inner flange.

FIG. 7 shows a second stage of the step. In this stage, the first support die 30 which is identical with that described with reference to FIG. 6 is continuously used, and a second pressing die 50 is used in place of the first pressing die 40 described with reference to FIG. 6. The second pressing die 50 comprises an annular recess 51 which is recessed by a dimension that is slightly shorter than the axial length H1 of the cylindrical portion 11 reduced by conducting the first stage described with reference to FIG. 6. The upper wall face of the recess 51 serves as a pressing face 52. The recess 51 has a size which enables the cylindrical portion 11 that has undergone the first stage described with reference to FIG. 6, to be inserted into the recess. When the cylindrical portion 11 that has undergone the first stage is fitted into the recess 51, the outer peripheral face 14 of the cylindrical portion 11 is supported by the first die face 53 which is formed by the outer peripheral face of the recess 51. The first die face 43 shown in FIG. 6 and the first die face 53 of FIG. 7 are in common with each other in that they exert a function of supporting the outer peripheral face 14 of the cylindrical portion 11 to prevent the face from being deformed.

When the second pressing die 50 is lowered from the upper side, the cylindrical portion 11 is fitted into the recess 51 of the second pressing die 50. Under this state, a load is applied to the second pressing die 50 so as to push down the second pressing die as shown by the arrow D. Then, under the state where deformation of the outer peripheral face 14 of the cylindrical portion 11 is blocked by the first die face 53 and that of the end face of the one end (the end face on the side of the lower end) of the cylindrical portion 11 is blocked by the second die face 32, the cylindrical portion 11 is pressed in the axial direction by the pressing face 52. The pressing force exerted at this time causes the axial length of the cylindrical portion 11 to be reduced to a value which is equal to the depth of the recess 51 (the axial length H2 is set to be H2<H1). Parallel with this reduction, excess metal produced as a result of the reduction of the axial length of the cylindrical portion 11 projects into the inside of the cylindrical portion 11. In FIG. 7, the width of the projection of the excess metal in this case is indicated by a reference numeral a2.

In the first stage described with reference to FIG. 6 and the second stage described with reference to FIG. 7, the excess metal is gradually gathered to one end part of the cylindrical portion 11 in parallel with the projection into the inside of the cylindrical portion 11. As closer to the one end part of the cylindrical portion 11, therefore, the excess metal projects inwardly by a larger degree.

FIG. 8 shows a third stage, i.e., the final stage of the step. In this stage, a second support die 60, a third pressing die 70, and a first outer die 80 are used. The sheet metal member 10 which has undergone the second stage described with reference to FIG. 7 is placed on the second support die 60. The second support die 60 has a second die face 62 which is configured by a horizontal support face. The back face of the center portion of the sheet metal member 10 is supported by the second die face 62. The second die face 32 shown in FIGS. 6 and 7 and the second die face 62 of FIG. 8 are in common with each other in that they exert a function of supporting the back face of the center portion of the sheet metal member 10 to prevent the end face of the one end of the cylindrical portion 11 from being deformed. By contrast, the third pressing die 70 and the first outer die 80 cooperate with each other so as to form an annular recess 71 which is recessed by a dimension that is slightly shorter than the axial length H2 of the cylindrical portion 11 which has undergone the second stage described with reference to FIG. 7. The upper wall face of the recess 71 serves as a pressing face 72. The recess 71 has a size which enables the cylindrical portion 11 which has undergone the second stage to be fitted into the recess. When the cylindrical portion 11 which has undergone the second stage is fitted into the recess 71, the outer peripheral face 14 of the cylindrical portion 11 is supported by a first die face 83 which is formed by the outer peripheral face of the recess 71. The first die faces 43 and 53 shown in FIGS. 6 and 7 and the first die face 83 of FIG. 8 are in common with each other in that they exert a function of supporting the back face of the center portion of the sheet metal member 10 to block the deformation of the end face of the one end of the cylindrical portion 11.

Figure 14:
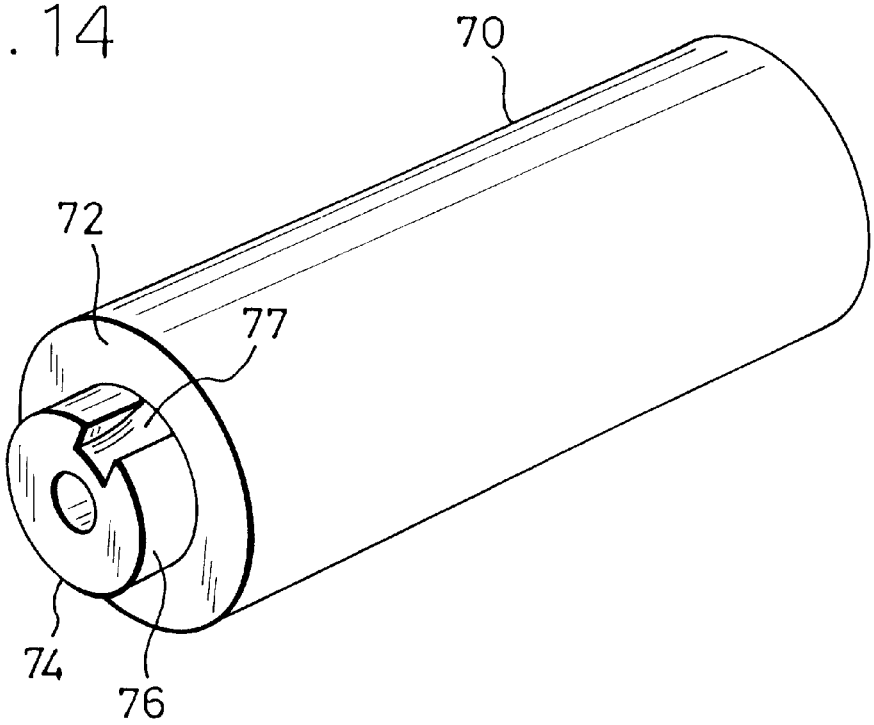
FIG. 14 is a schematic perspective view of a third pressing die.
Figure 15:
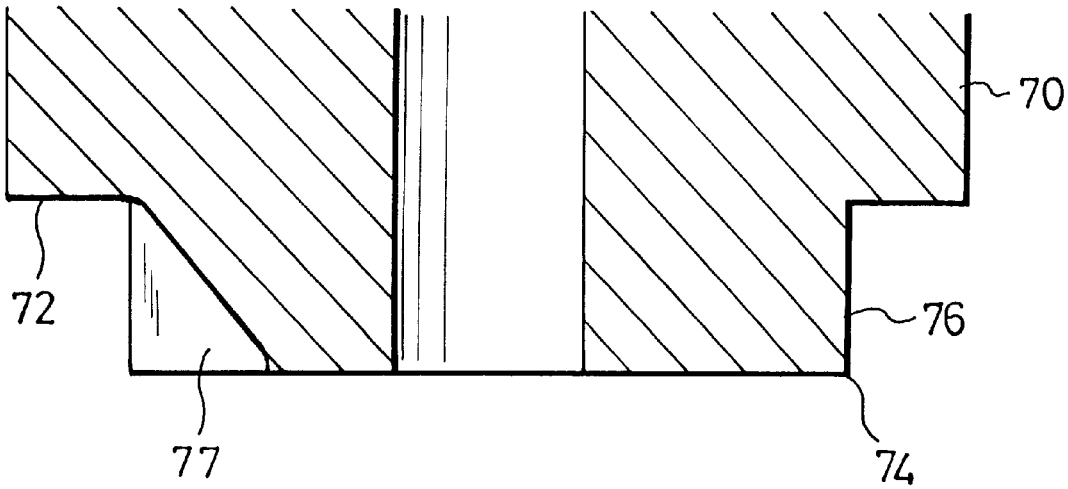
FIG. 15 is an enlarged section view of main portions of the third pressing die.

As shown in FIGS. 14 and 15, the third pressing die 70 comprises a projected shaping face 76 on a shaft 75 which has a lower end face serving as the pressing face 72. A recessed shaping face 77 is formed in one place of the peripheral direction of the projected shaping face 76.

The sheet metal member 10 which has undergone the second stage is placed on the second support die 60 of FIG. 8, the back face of the center portion of the sheet metal member 10 is supported by the second die face 62 of the second support die 60, and the plate portion 12 of the sheet metal member 10 is pressed by the first outer die 80. When the third pressing die 70 is thereafter lowered from the upper side, the cylindrical portion 11 is fitted into the recess 71 which is formed by cooperation of the first outer die 80 and the third pressing die 70. Under this state, a load is applied to the third pressing die 70 so as to push down the third pressing die 70 as shown by the arrow D. Then, under the state where deformation of the outer peripheral face 14 of the cylindrical portion 11 is blocked by the first die face 83 and that of the end face of the one end (the end face on the side of the lower end) of the cylindrical portion 11 is blocked by the second die face 62, the cylindrical portion 11 is pressed in the axial direction by the pressing face 72. The pressing force exerted at this time causes the axial length of the cylindrical portion 11 to be reduced to a value which is equal to the depth of the recess 71 (the axial length H3 is set to be H3<H2). Parallel with this reduction, excess metal produced as a result of the reduction of the axial length of the cylindrical portion 11 projects into the inside of the cylindrical portion 11. The projection of the excess metal at this time occurs in an area under the projected shaping face 76 of the third pressing die 70, and an area corresponding to the recessed shaping face 77 formed in the projected shaping face 76. In the area surrounding the recessed shaping face 77, the projection of the excess metal is suppressed by the projected shaping face 76. In FIG. 8, the width of the projection of the excess metal to the area under the projected shaping face 76 of the third pressing die 70 is indicated by a reference numeral a3.

In the final stage of FIG. 8, the one end part of the cylindrical portion 11, and the root part of the excess metal which is gathered to the one end part of the cylindrical portion 11 to project inwardly are formed in a substantially perpendicular relationship. Specifically, a shaping face 74 which is substantially perpendicular to the projected shaping face 76 of the third pressing die 70 is formed, and the one end part of the cylindrical portion 11 and the root part of the excess metal are pressed by the shaping face 74.

In the third stage of the step, as shown in FIG. 8, a column-like core 90 is concentrically inserted into the cylindrical portion 11. The end face of the inward projected part of the excess metal on the inner peripheral side is pressed against a shaping face 91 of the core 90. This countermeasure is effective in the case where the inner peripheral end face of the inner flange 15 which is formed by the excess metal is to be finished smoothly and highly accurately.

Figure 12:
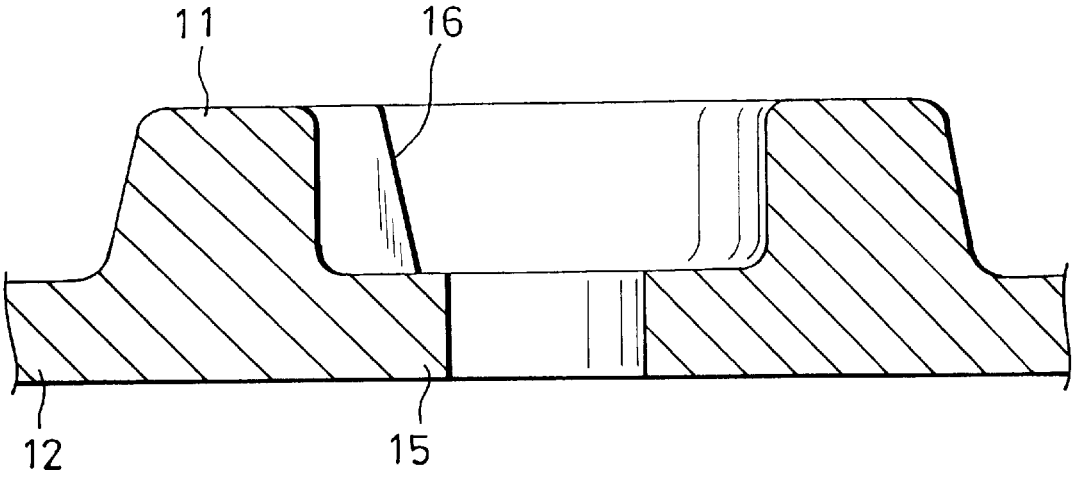
FIG. 12 is a section view showing main portions of a sheet metal member having a key portion.
Figure 13:
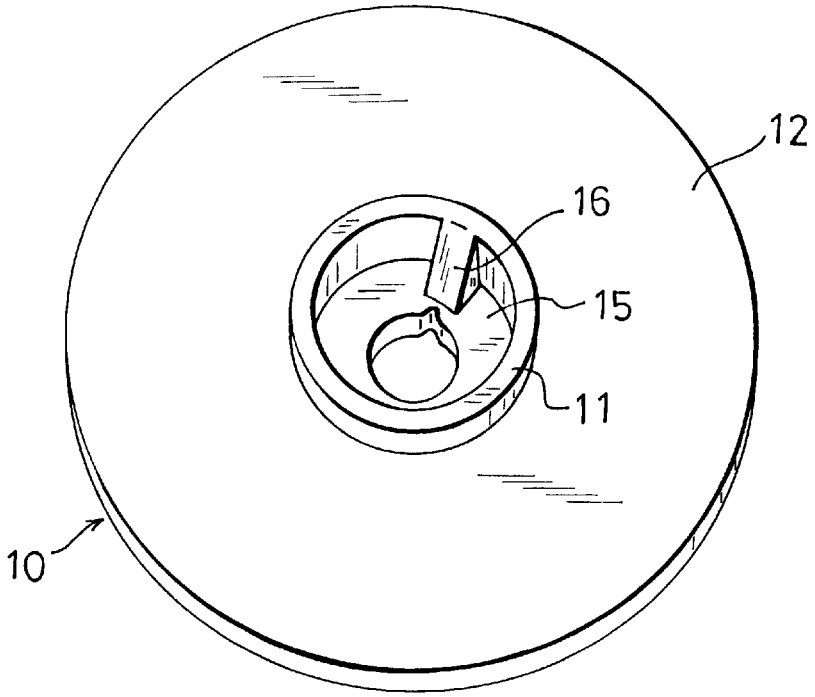
FIG. 13 is a perspective view showing the sheet metal member having the key portion.

FIGS. 12 and 13 show the sheet metal member 10 which has undergone the above-described stages. As shown in the figures, the sheet metal member 10 has the boss-like cylindrical portion 11 at the center of the circular plate portion 12, the inner flange 15 which is formed by the excess metal is disposed on one end part of the cylindrical portion 11, and the key portion 16 which is continued from the upper face of the inner flange 15 and the inner peripheral face of the cylindrical portion 11 is integrally formed. In the thus configured sheet metal member 10, the key portion 16 serves as the key which has been described in the beginning of the specification. A gear or a pulley V-groove may be freely formed in the outer periphery of the sheet metal member 10.

The first support die 30, the first pressing die 40, the second pressing die 50, the second support die 60, the third pressing die 70, the first outer die 80, and the like dies which have been described with reference to FIGS. 6 to 8 correspond to pressing dies attached to a press machine. Among these dies, the first pressing die 40, the second pressing die 50, and the third pressing die 70 are moved in the axial direction of the cylindrical portion 11.

In the embodiment described above, the pressing process in the inner flange forming step including the key portion forming step is conducted in several stages. Depending on the material of the sheet metal member 10, these stages may be conducted as a single stage. The sheet metal member 10 used in the embodiment is made of SAPH440 (high tension steel). When the pressing process is conducted in several stages as described above, the finished shape of the inner flange 15 is highly accurate.

Figure 9:
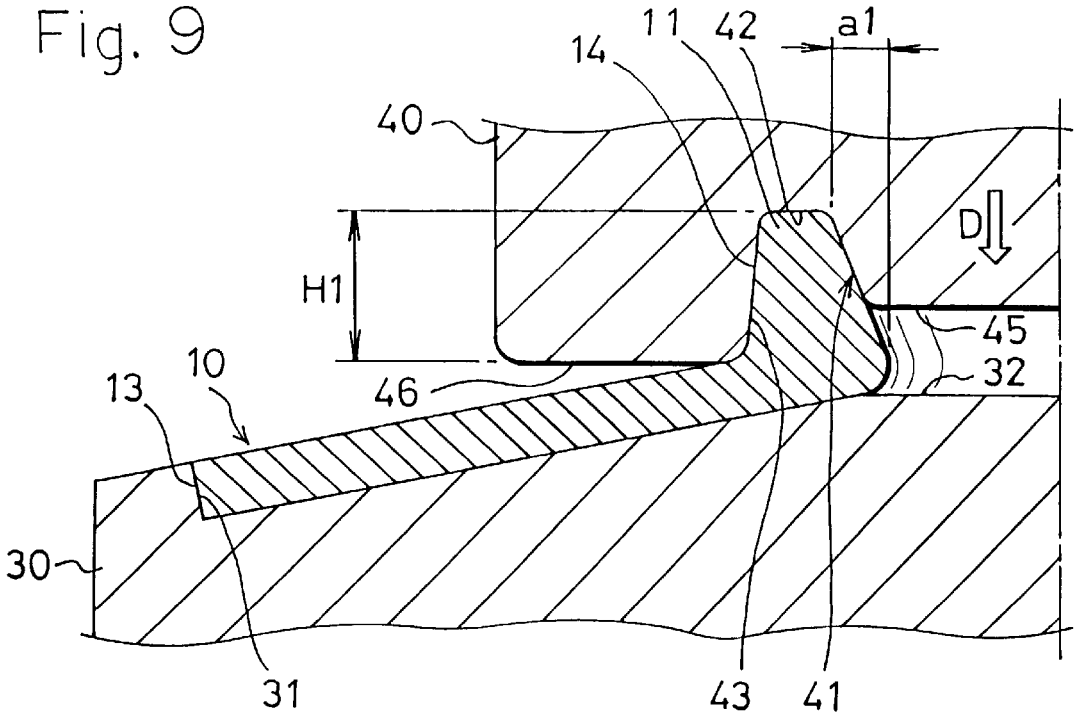
FIG. 9 is a view showing a partial section to illustrate a first stage of a step of forming an inner flange which is suitable for a sheet metal member having a cylindrical portion of a large diameter.
Figure 10:
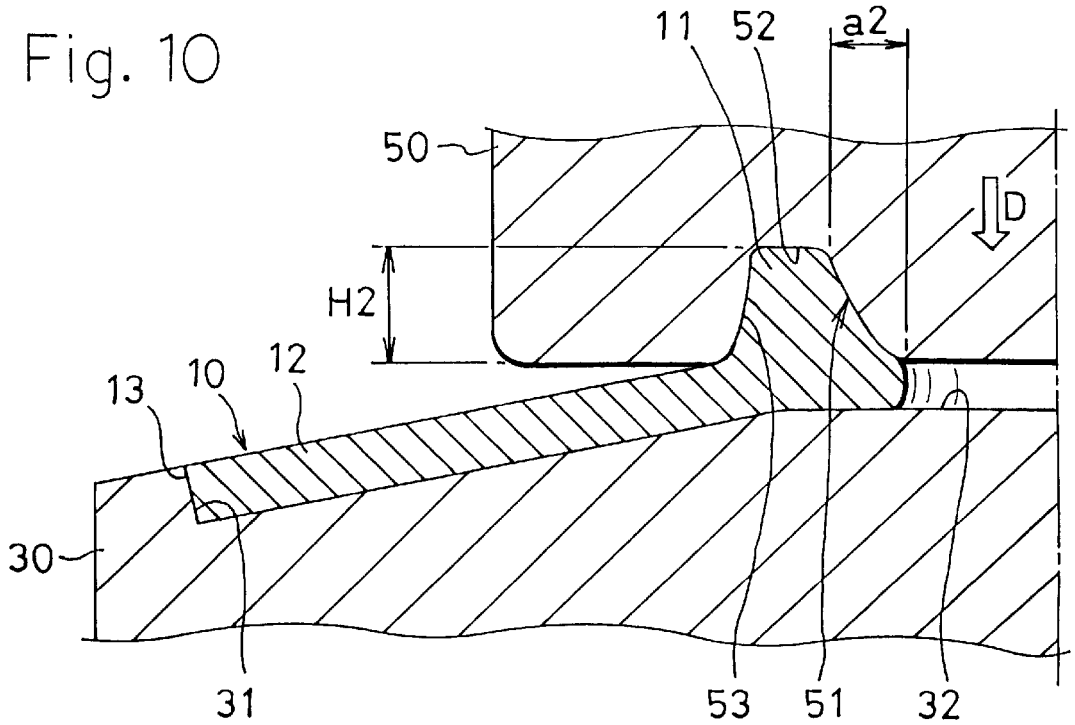
FIG. 10 is a view showing a partial section to illustrate a second stage of the step of forming an inner flange which is suitable for a sheet metal member having a cylindrical portion of a large diameter.
Figure 11:
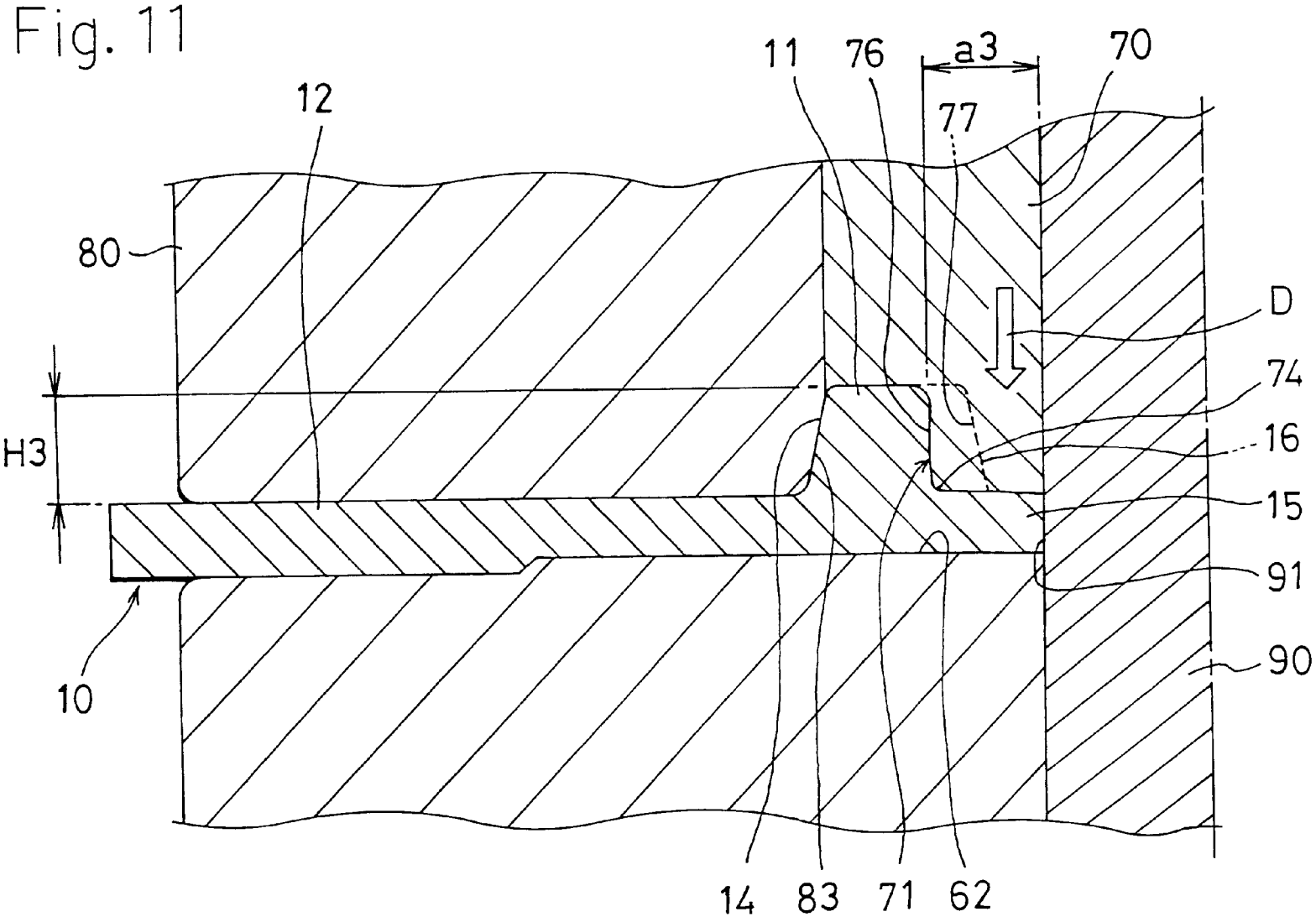
FIG. 11 is a view showing a partial section to illustrate a third stage (key portion forming step) of the step of forming an inner flange which is suitable for a sheet metal member having a cylindrical portion of a large diameter.

FIGS. 9 to 11 show a method which is suitable for formation of the key portion 16 and the inner flange 15 in the sheet metal member 10 having the cylindrical portion 11 of a large diameter. FIG. 9 shows the first stage corresponding to FIG. 6, FIG. 10 the second stage corresponding to FIG. 7, and FIG. 11 the third stage corresponding to FIG. 8.

In this method, the first pressing die 40 used in the first stage of FIG. 9 is different from the die shown in FIG. 6 in that a lower face 45 which is inside the recess 41 is positioned at a level slightly higher than that of a lower face 46 which is outside the recess. The other components are identical with those described with reference to FIGS. 5 to 8. Therefore, identical or corresponding components are designated by the same reference numerals and their detailed description is omitted.

In the sheet metal member 10 shown in FIGS. 7 and 10, as seen from these figures, the inner peripheral face of the cylindrical portion 11 integrated therewith has a diameter which is gradually reduced when moving toward an end (in the illustrated example, the lower end) in the axial direction of the cylindrical portion 11. When the key portion 16 shown in FIGS. 8 and 11 is to be formed by using the third pressing die 70 shown in FIG. 14, therefore, the inner metal part of the cylindrical portion 11 is removed by the pressing operation of the third pressing die 70 in the axial direction in the same manner as the case described with reference to FIGS. 1 to 3. However, the inner metal part corresponding to the recessed shaping face 77 of the third pressing die 70 is not removed so as to be the remaining metal. The remaining metal cooperates with the excess metal produced as a result of the reduction of the axial length of the cylindrical portion 11 so that the key portion 16 is sufficiently projected from the inner peripheral face of the cylindrical portion 11.

The entire disclosure of Japanese Patent Application No. 9-12562 filed on Jan. 27, 1997 including specification, claims, drawings and summary are incorporated herein by reference in its entirety.

What is claimed is:

1. A method of forming a key portion of a sheet metal member having a cylindrical portion, the cylindrical portion having an outer peripheral face, a given axial length defining an axial direction, and an inside, comprising the steps of: pressing the cylindrical portion in an axial direction to reduce the given axial length of the cylindrical portion; and allowing excess metal to project into the inside of the cylindrical portion, thereby forming an inner flange, and wherein an inner peripheral part of the cylindrical portion projects into the inside of said cylindrical portion, thereby forming the key portion.

2. A method of forming a key portion of a sheet metal member having a cylindrical portion according to claim 1, wherein the place where the excess metal projects into the inside of said cylindrical portion and the inner flange is formed is an end part in the axial direction of the cylindrical portion.

3. A method of forming a key portion of a sheet metal member having a cylindrical portion according to claim 2, wherein a pressing die is moved in the axial direction of the cylindrical portion for formation of the inner flange and formation of the key portion.

4. A method of forming a key portion of a sheet metal member having a cylindrical portion according to claim 1, wherein a pressing die is moved in the axial direction of the cylindrical portion for formation of the inner flange and formation of the key portion.

5. A method of forming a key portion of a sheet metal member having a cylindrical portion according to claim 4, further comprising the step of: blocking deformation of an outer peripheral face of said cylindrical portion by a first die face formed on the pressing die.

6. A method of forming a key portion of a sheet metal member having a cylindrical portion according to claim 5, further comprising the step of: blocking deformation of an end face of one end side of the cylindrical portion by a second die face formed on the pressing die.

7. A method of forming a key portion of a sheet metal member having a cylindrical portion according to claim 1, further comprising the step of: blocking deformation of the outer peripheral face of the cylindrical portion by a first die face formed on the pressing die.

8. A method of forming a key portion of a sheet metal member having a cylindrical portion according to claim 7, further comprising the step of: blocking deformation of an end face of one end side of the cylindrical portion by a second die face formed on the pressing die.

9. A method of forming a key portion of a sheet metal member having a cylindrical portion according to claim 1, wherein said key portion is formed by the excess metal produced as a result of the reduction of the axial length of the cylindrical portion, and a remaining metal remaining of the inner metal part of the cylindrical portion when the inner metal part is removed.

10. A method of forming a key portion of a sheet metal member having a cylindrical portion according to claim 1, wherein the cylindrical portion is a cylindrical boss.

* * * * *